United States Patent [19]

Spota

[11] Patent Number: 4,918,849

[45] Date of Patent: Apr. 24, 1990

[54] MUZZLE-LOADING FIREARM

[76] Inventor: Angel H. L. Spota, 1808 Old Meadow Rd., McLean, Va. 22102

[21] Appl. No.: 343,589

[22] Filed: Apr. 27, 1989

[51] Int. Cl.[5] ..... F41C 27/00

[52] U.S. Cl. ..... 42/51

[58] Field of Search ..... 42/51, 83, 90

[56] References Cited

U.S. PATENT DOCUMENTS

| | | | |
|---|---|---|---|
| 173,476 | 2/1876 | Ladd | 42/51 |
| 3,451,154 | 6/1969 | Goble | 42/51 |
| 4,137,663 | 2/1979 | Farber | 42/51 |
| 4,232,468 | 11/1980 | Chapin | 42/51 |
| 4,283,874 | 8/1981 | Vaughn | 42/51 |
| 4,437,249 | 3/1984 | Brown et al. | 42/51 |
| 4,503,633 | 3/1985 | Davis | 42/51 |

*Primary Examiner*—Charles T. Jordan

*Attorney, Agent, or Firm*—Antonelli, Terry & Wands

[57] ABSTRACT

The present invention discloses a muzzle-loading firearm which includes a stock, a barrel integral with or fastened to the stock, having an opening of substantially constant cross-section extending longitudinally within the barrel from a muzzle end of the barrel toward the breech end of the barrel, and having a longitudinally extending chamber at the breech end of the barrel which has a larger cross-sectional area than that of the opening, a breech plug or other means for closing the chamber at the breech end thereof, and a lock operably connected to the chamber for igniting the charge in the chamber.

4 Claims, 2 Drawing Sheets

MUZZLE-LOADING FIREARM

BACKGROUND OF THE INVENTION

The present invention relates to muzzle-loading firearms and, more particularly, to muzzle-loading firearms which are capable of propelling a projectile therefrom with greater force than conventional muzzle-loading firearms of equivalent caliber.

Muzzle-loading firearms were an early development in the evolution of small firearms. The term "muzzle-loading" refers to the manner in which the propellant charge and projectile are loaded into the gun. Muzzle-loading firearms are loaded first with a propellant, i.e., black powder, and then a projectile, i.e., a ball or bullet, through the open discharge end or muzzle end of the gun. The ball or bullet is tamped in place providing a single shot before reloading is required.

The propellant charge is ignited through a touch or flash hole so as to explode the propellant and propel the projectile. Muzzle-loading firearms were originally of the matchlock type wherein a slow-burning match was lowered over the touch hole in the breech to ignite the propellant charge. Later, flintlock mechanisms and percussion-lock mechanisms were developed. The flintlock mechanism generally made use of a hammer for striking a spark to ignite the charge, while the percussion-lock mechanism used a cap or container holding a small explosive charge which, when struck by the hammer, caused a flame to flow through the flash hole to ignite the charge.

Muzzle-loading firearms are obviously of interest to gun collectors as such firearms represent an important stage in the evolution of modern firearms. In addition, though, muzzle-loading firearms are also in great demand by sportsmen for hunting.

In response to this great demand, a variety of converting devices for converting modern, breech-loading firearms to muzzle-loading firearms have been developed. Examples of such conversion devices are disclosed in U.S. Pat. No. 4,232,468 to Chapin; U.S. Pat. No. 4,437,249 to Brown et al; and U.S. Pat. No. 173,476 to Ladd. However, these devices only temporarily convert a breech-loading firearm to a muzzle-loading type firearm and are obviously not as desirable to a gun collector or sportsman who desires an authentic old muzzle-loading firearm or a replica of the same.

Conventional muzzle-loading firearms and replicas of the same suffer from the disadvantage that the projectile cannot be propelled with great force, such as can the projectile from a modern, breech-loading cartridge-type firearm. This disadvantage is due to the fact that conventional muzzle-loading firearms include a barrel having a bore of constant caliber from the muzzle to the breech end thereof. This caliber is consistent with the caliber of the projectile used. Accordingly, the cross-sectional area of the breech end of the bore which is to contain the powder charge is insufficient to place a large volume of charge therein. Use of too much powder in a conventional muzzle-loading firearm can result in incomplete ignition of the charge and fouling of the bore.

Accordingly, it is desired to provide a muzzle-loading firearm at least the outside appearance of which is the same as authentic old muzzle-loading guns, but which is capable of propelling a projectile with greater force than a conventional muzzle-loading gun of equivalent caliber.

SUMMARY OF THE INVENTION

The present invention obviates the above-identified problems and provides a muzzle-loading firearm which includes a stock, a barrel integral with or fastened to the stock, having an opening of substantially constant cross-section extending longitudinally within the barrel from a muzzle end of the barrel toward the breech end of the barrel, and having a longitudinally extending chamber at the breech end of the barrel which has a larger cross-sectional area than that of the opening, closing means for closing the chamber at the breech end thereof, and lock means operably connected to the chamber for igniting the charge in the chamber.

By providing a chamber at the breech end of the barrel with a larger cross-sectional area than that of the opening or bore of the barrel, a greater volume of powder can be provided in the chamber as compared to a conventional straight bore muzzle-loading gun. The increased volume of powder allows the projectile to be propelled with greater force than with conventional muzzle-loading firearms. The outside appearance of the muzzle-loading firearm of the present invention can be made the same as that of authentic old muzzle-loading guns.

Detaining means can be provided for preventing the projectile from entering the enlarged chamber of the gun of the present invention. The detaining means can take the form of a screw passing through the barrel and extending into the bore at a position adjacent the chamber or can comprise an opening between the chamber and bore having a reduced cross-sectional area as compared to the bore.

The closing means can be, e.g., a standard breech plug which screws into the breach end of the barrel or can be made integral with the barrel. The closing means is permanently or semi-permanently fixed to the breech end of the barrel. The term "semi-permanently fixed" is intended to mean that the closing means is permanently fixed during the operation of the firearm, i.e., during loading and firing, but can be removed if desired for cleaning, etc.

The lock means can be any lock means known in the muzzle-loading firearm art, and can include an opening extending through the barrel of the gu or through the breech plug to communicate with the chamber in the barrel.

The chamber is preferably bullet-shaped with the breech end having a concave portion.

If desired, the bore of the barrel can be rifled, i.e., spiral grooves may be provided on the interior surface of the barrel.

DESCRIPTION OF THE PREFERRED EMBODIMENTS

Figure 1:
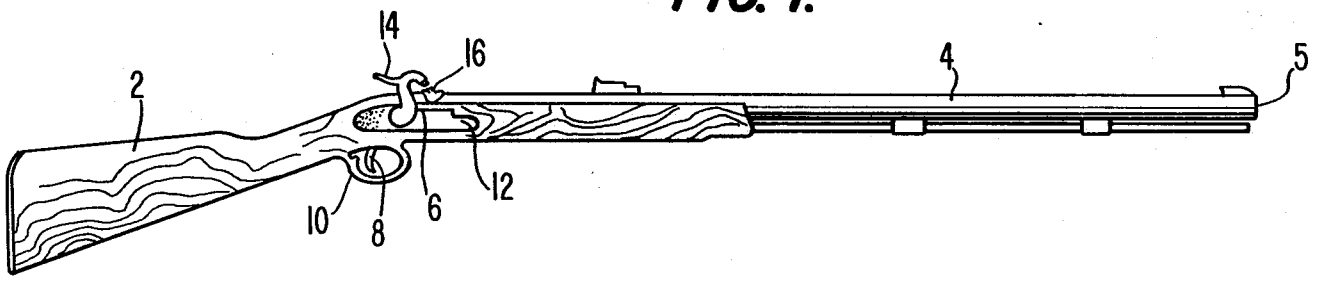
FIG. 1 is a side elevational view of the muzzle-loading firearm of the present invention.

Referring now to the drawings, FIG. 1 shows a side elevational view of a muzzle-loading firearm according to the present invention. As shown in FIG. 1, the firearm of the present invention resembles, from the outside, a conventional muzzle-loading firearm. The firearm includes stock 2 and, connected thereto, barrel 4 having discharge or muzzle end 5 and breech end 6. The barrel 4 can be connected to stock 2 by, e.g., barrel bands, although other fastening means known in the art can be used, or the barrel 4 can be integral with stock 2.

FIG. 1 shows a embodiment of the present invention wherein a percussion lock mechanism is used, although other mechanisms known in the art, such as matchlock, flintlock or wheel-lock, can be used. In this embodiment, the firearm has trigger 8, trigger guard 10, lock plate 12, hammer 14 and plug 16. A percussion cap containing, e.g., a small quantity of fulminate can be placed on plug 16 to create a flash when struck by hammer 14. As shown in more detail in FIG. 3, the flash travels through chimney 18 and flash hole 20 to ignite a charge placed in chamber 24.

Figure 2:
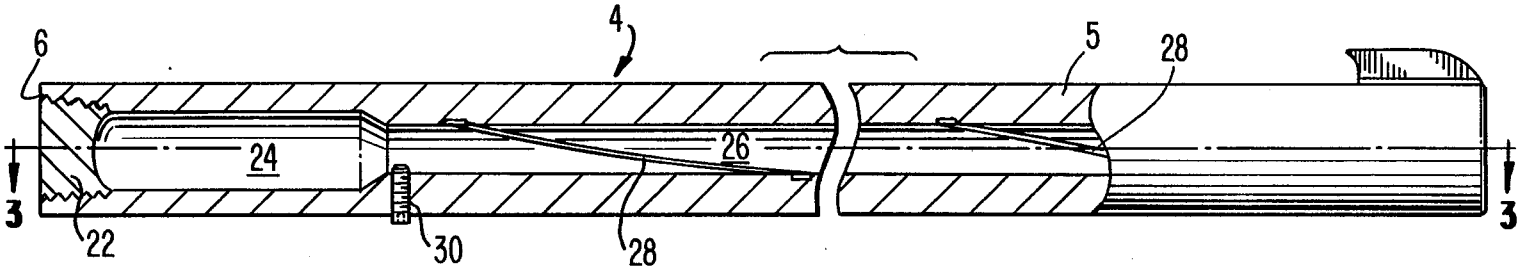
FIG. 2 is a side elevational view, partially in section, of a portion of the firearm shown in FIG. 1.
Figure 3:
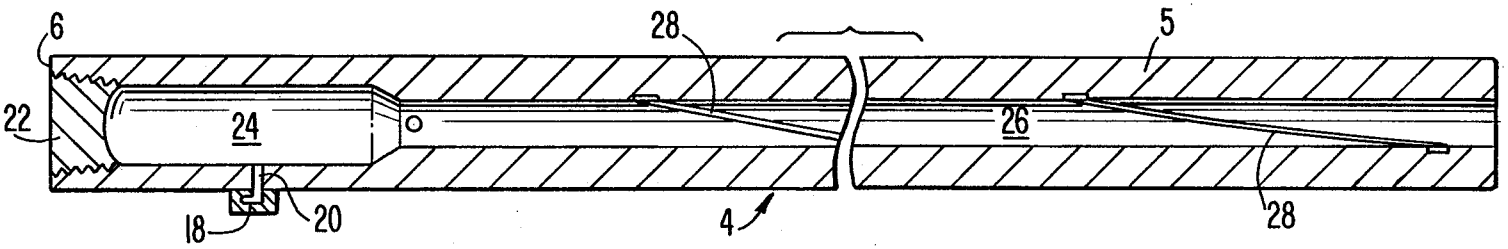
FIG. 3 is a top elevational view, partially in section, of a portion of the firearm shown in FIG. 1 along line 3—3 of FIG. 2.

The barrel of the firearm of the present invention is shown in more detail in FIGS. 2 and 3. As shown in Figs. 2 and 3, the barrel 4 has an opening or bore 26 which opens to the outside at muzzle end 5 and opens to chamber 24 at breech end 6. Chamber 24 is closed at breech end 6 by any closing means known in the art, such as by breech plug 22. Alternatively, the barrel 4 can contain a portion integral therewith to close off chamber 24 at breech end 6, e.g., as in the embodiment shown in FIG. 4.

Figure 4:
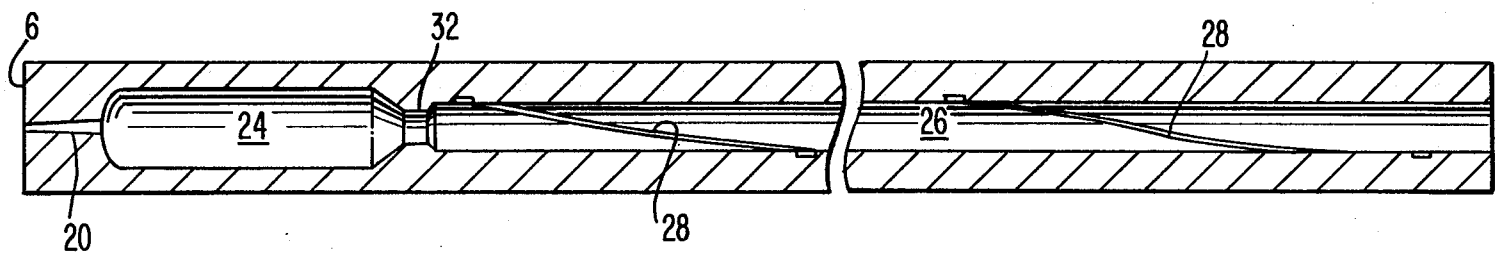
FIG. 4 is a side cross-sectional view of another embodiment of the muzzle-loading firearm of the present invention.

If closing means integral with the barrel 4 is used, such as shown in FIG. 4, the closing means can be considered to be permanently fixed o integral with the breech end of the barrel. Alternatively, if closing means such as breech plug 22 shown in FIGS. 2 and 3 is used such as by screwing the breech plug into the breech end 6 of barrel 4, the closing means 22 can be considered to be semi-permanently fixed to breech end 6 of barrel 4. That is, the closing means or breech plug 22 is permanently fixed to breech end 6 or barrel 4 during operation of the firearm, i.e., during loading and firing of the firearm, but is removable, such as by unscrewing the plug 22, for cleaning the firearm. Thus, the firearm of the present invention is permanently of the muzzle-loading type.

The chamber 24 has a cross-sectional area larger than the cross-sectional area of opening or bore 26. This enables a larger volume of propellant charge to be inserted in chamber 24 than would be possible with a conventional straight bore muzzle-loading firearm. Accordingly, the present invention enables a projectile to be expelled with greater force than conventional muzzle-loading firearms. The chamber 24 preferably has a concave portion defined by the breech end 6 of barrel 4 or by breech plug 22, a truncated conically shaped portion adjacent and open to opening or bore 26, and a cylindrically shaped portion between the concave portion and the truncated conically shaped portion. That is, preferably the cylindrically shaped portion tapers down to the bore 26 at a predetermined angle. Such a shape allows the propellant charge to act as if in a cartridge of the same dimensions. However, other shapes may be used for chamber 24 as long as the cross-sectional area thereof is greater than the cross-sectional area of opening or bore 26. The particular shape and size of chamber 24 is selected based on the desired firing characteristics of the gun. For example, the diameter of the chamber 24 may be 1.1 to 1.5 times the diameter of the opening or bore 26. For example, the bore 26 may be ½ inch in diameter, while the chamber 24 may be ⅝ inch.

As best shown in FIG. 2, a screw 30 can be provided through barrel 4 and extending into opening or bore 26 at a portion adjacent chamber 24. Screw 30 acts as a detaining means to prevent a projectile inserted in opening or bore 26 from entering chamber 24.

As shown in FIG. 4, in an alternative embodiment, in place of screw 30, detaining means 32 can be provided. Detaining means 32 comprise a constricted section such that an aperture between chamber 24 and opening or bore 26 has a cross-sectional area in a plane parallel to the cross-sectional area of opening or bore 26 which is smaller than the cross-sectional area of opening or bore 26. Detaining means 32 also prevents a projectile inserted in opening or bore 26 from entering chamber 24. FIG. 4 also shows an alternative embodiment wherein the flash hole 20 is provided at the breech end 6 of barrel 4.

To operate the firearm of the present invention, muzzle end 5 of barrel 4 of the firearm is pointed generally vertically upwards and a propellant charge, such as black powder, is introduced through muzzle end 5 and opening or bore 26 into chamber 24. After introduction of the propellant charge, a projectile can be inserted through muzzle end 5 into opening or bore 26. If desired, the ball or bullet can be wrapped in wet or greased paper or cloth wadding and tamped by a ramrod to place the ball or bullet against detaining means such as screw 30 or constricted section 32.

A percussion cap is then placed on plug 16. Hammer 14 is actuated to explode the percussion cap and send a flash through chimney 18 and flash hole 20 to ignite the propellant charge in chamber 24 and propel the projectile through opening or bore 26 and out muzzle end 5.

If desired, the opening or bore 26 can be rifled as known in the art, i.e., can contain spiral grooves 28 to cause a projectile to rotate about its longitudinal axis as it is propelled through opening or bore 26.

Figure 5:
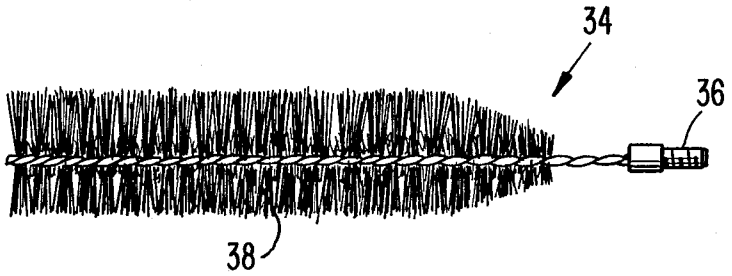
FIG. 5 is a side elevational view of a brush which may be used to clean the muzzle-loading firearm of the present invention.

To conveniently clean chamber 24, a specially shaped brush 34, such as shown in FIG. 5, can be used. Brush 34 has shaft 36 and bristles 38. The bristles 38 form a shape which conforms to the shape of chamber 24.

While I have shown and described more than one preferred embodiment in accordance with the present invention, it is understood that the same is not limited thereto, but is susceptible to numerous changes and modifications as known to a person having ordinary skill in the art, and I therefor do not wish to be limited to the details shown and described herein, but intend to cover all such modifications as are encompassed by the scope of the appended claims.

I claim:

1. A muzzle-loading firearm comprising:

a stock;

a barrel integral with or fastened to said stock, said barrel having an opening of substantially constant cross-section extending longitudinally within said barrel from a muzzle end of said barrel toward a breach end of said barrel and a longitudinally extending chamber at said breach end of said barrel, said chamber having a larger cross-sectional area than that of said opening;

closing means for closing said chamber at said breech end of said barrel, said closing means being integral with or fixed to said barrel at said breech end thereof;

lock means operably connected to said chamber for igniting a charge in said chamber; and detaining means for preventing a projectile inserted in said opening of said barrel from entering said chamber.

2. A muzzle-loading firearm according to claim 1, wherein said detaining means comprises a screw passing through said barrel and extending into said opening at a position adjacent said chamber.

3. A muzzle-loading firearm according to claim 1, wherein said detaining means comprises an aperture between said chamber and said opening having a cross-sectional area in a plane parallel to said cross-sectional area of said opening which is smaller than said cross-sectional area of said opening.

4. A muzzle-loading firearm according to claim 3, wherein said chamber has a longitudinally extending cylindrical portion adjacent said closing means and a truncated conical portion adjacent said opening, the base of which has a diameter equal to that of said cylindrical portion and is adjacent said cylindrical portion.

* * * * *